United States Patent [19]

Sato

[11] Patent Number: 5,051,783

[45] Date of Patent: Sep. 24, 1991

[54] CAM FOR SHIFTING A TRANSFER DEVICE AND A CLEANING DEVICE

[75] Inventor: Kenji Sato, Hachioji, Japan

[73] Assignee: Konica Corporation, Tokyo, Japan

[21] Appl. No.: 557,380

[22] Filed: Jul. 24, 1990

[30] Foreign Application Priority Data

Jul. 29, 1989 [JP] Japan ..... 1-89554
Oct. 13, 1989 [JP] Japan ..... 1-267284

[51] Int. Cl.[5] ..... G03G 15/14; G03G 21/00

[52] U.S. Cl. ..... 355/271; 355/296; 355/326

[58] Field of Search ..... 355/270, 271, 277, 296, 355/297, 299, 301, 326

[56] References Cited

U.S. PATENT DOCUMENTS 3,819,261 6/1974 Ogawa ..... 355/271
4,465,363 8/1984 Schmitt et al. ..... 355/297
4,905,048 2/1990 Suzuki ..... 355/271

*Primary Examiner*—Joan H. Pendegrass
*Assistant Examiner*—P. J. Stanzione
*Attorney, Agent, or Firm*—Frishauf, Holtz, Goodman & Woodward

[57] ABSTRACT

An electrophotographic apparatus having a cam mechanism for shifting a transfer unit and a cleaning unit of the apparatus, enabling both of them to take a contacted position and a separated position with the surface of the photoreceptor drum to perform the functions of toner image transfer and residual toner cleaning in an ordered timing. The cam mechanism is provided with a cam which is driven to rotate intermittently around an axis of the photoreceptor drum, and a transfer cam follower and a cleaning cam follower are guided by the cam. The transfer cam follower shifts the transfer unit to take a transfer position in a transfer time interval and shifts the transfer unit to a separated position from the surface of the photoreceptor drum in a non-transfer time interval. The cleaning cam follower shifts the cleaning unit to a cleaning position in a cleaning time interval and shifts the cleaning unit to a separated position from the surface of the photoreceptor in a non-cleaning time interval.

4 Claims, 6 Drawing Sheets

FIG. 5(A) PHASE I
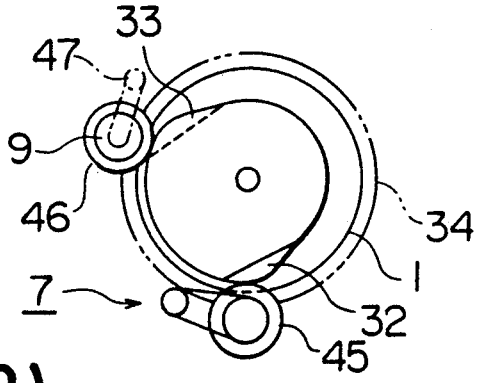
FIG. 5(B) PHASE II
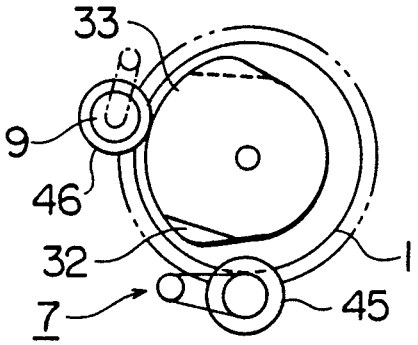
FIG. 5(C) PHASE III
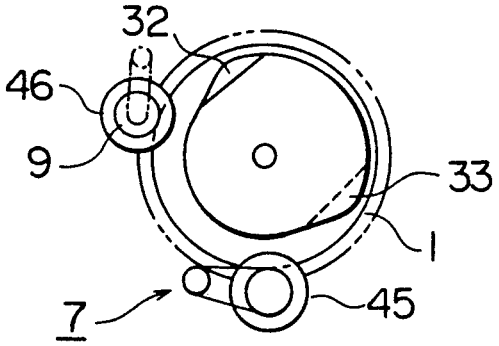
FIG. 5(D) PHASE IV
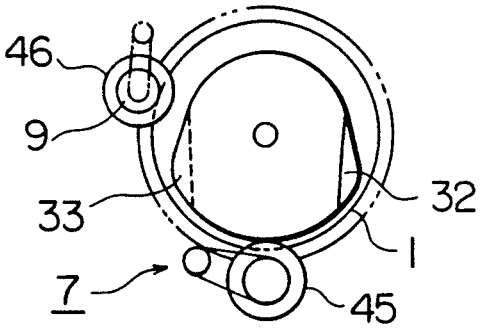

CAM FOR SHIFTING A TRANSFER DEVICE AND A CLEANING DEVICE

BACKGROUND OF THE INVENTION

The invention relates to a color electrophotographic apparatus, and relates more particularly to a color electrophotographic apparatus in which a color image is transferred after the color image was superimposed on a photoreceptor drum.

Up to the present, the following electrophotographic apparatuses have been widely known: a color electrostatic copier in which color images can be copied by the electrophotographic process; and a color printer in which color images can be recorded according to color image signals which are transmitted from the outside. Among these apparatuses, there is a color image recording apparatus which is characterized in that: the color images (yellow, magenta, cyan, black and the like) are superimposed on a photoreceptor; and then the superimposed color images are recorded on a recording paper being pressed by a transfer belt. The developer which remains on the photoreceptor drum is removed by the cleaning device (a blade or a brush). As explained above, in this type of apparatuses, the color images are developed at each color and superimposed. Consequently, the transfer belt and the cleaning device must be separated from the photoreceptor drum until the development of all color images is over. Accordingly, in the case of the conventional electrophotographic color apparatus, the separation means in which a magnetic clutch and a cam are combined or in which a solenoid, a spring clutch and a cam are combined, are provided to each of the transfer means and the cleaning means, and the transfer means and the cleaning means are separated from the photoreceptor by each separation means. Accordingly, the following problems exist in the conventional apparatus: as two sets of separation mean must be provided to the apparatus, it results in increased number of parts and increased cost, and the chance of a mechanical trouble is large; and the timing difference of the motion between the transfer means and the cleaning means tends to become incorrect.

The present invention has been achieved to solve the problems described above. The object of the present invention is to provide a color electrophotographic apparatus which is characterized in that: the transfer means and the cleaning means are attached to and separated from the photoreceptor drum by almost common separation means; accordingly, the number of parts can be decreased; as a result, the cost of the apparatus can be reduced and the chance of a mechanical trouble is small; and the timing of the motion of the transfer means is scarcely deviated from that of the cleaning means.

The above-described object can be attained by the color electrophotographic apparatus of the present invention in which a color image is formed on the photoreceptor by repeatedly forming toner images of different colors and superimposing them, and after that the color toner image is directly or indirectly transferred onto a transfer paper and fixed, and which is characterized in that: the transfer means and the cleaning means installed around the photoreceptor drum can be attached to and removed from the photoreceptor drum by a cam which can be rotated around the shaft of the photoreceptor drum.

In the color photoelectric apparatus of the present invention, the transfer means and the cleaning means can be attached to and removed from the surface of the photoreceptor drum driven by a pair of cams. These cams are integrally formed, and are driven by a driver to rotate around the rotating axis of the photoreceptor drum but with an independent rotating speed. Accordingly, the number of parts can be reduced, which results in the decrease in the cost and the mechanical trouble, and furthermore the following effect can be obtained: when the transfer mean and the cleaning means are attached to and removed from the photoreceptor drum, the timing of the motion of the transfer means is not deviated from that of the cleaning means.

BRIEF DESCRIPTION OF THE DRAWINGS

FIGS. 5(A), 5(B), 5(C), and 5(D) are drawings which illustrate the positions of the cam at each phase.

DETAILED DESCRIPTION OF THE INVENTION

Figure 1:
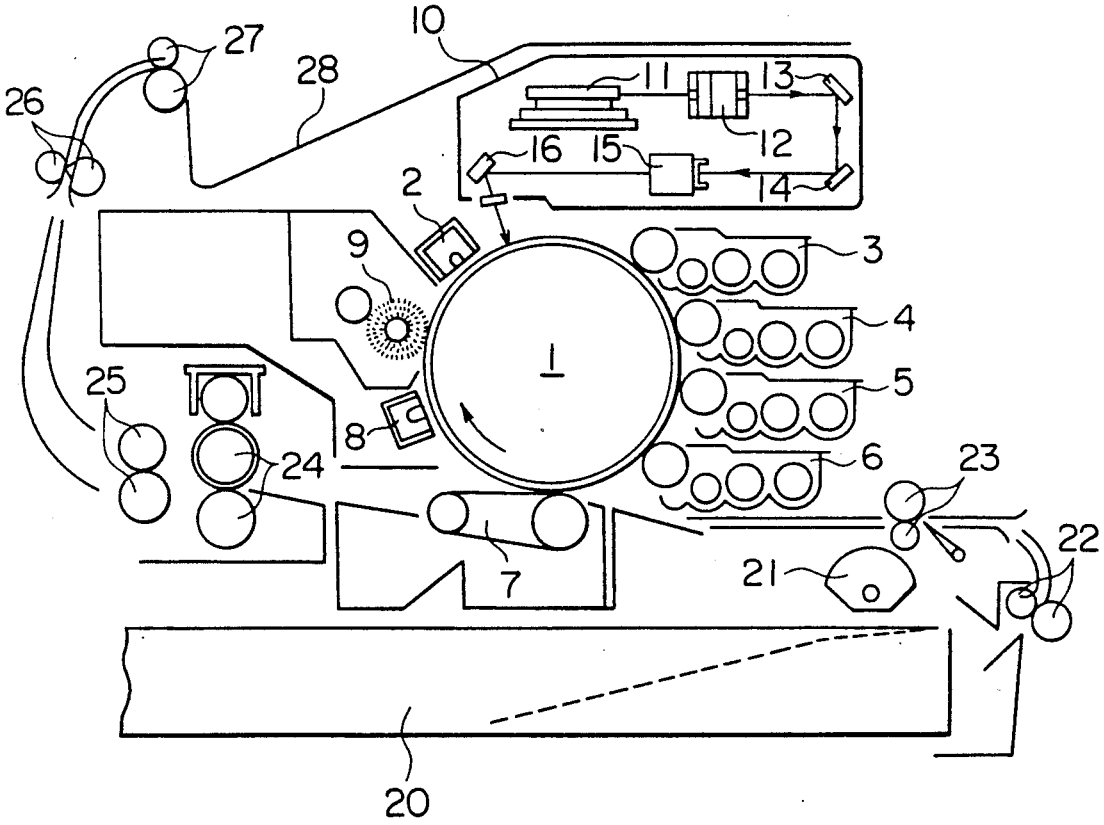
FIG. 1 is a schematic illustration of a color printer to which an example of the present invention is applied.

Referring now to the drawings, the apparatus of the present invention will be described as follows.

The first example of the present invention is illustrated in FIG. 1 to FIG. 5.

FIG. 1 is a schematic illustration of a color laser printer to which an example of the present invention is to be applied. In FIG. 1, the numeral 1 is a photoreceptor drum. The numeral 2 is an electrostatic charging electrode which charges the surface of the photoreceptor drum 1. The numeral 3, 4, 5 and 6 are magnetic brush type developing units containing the toners of yellow, magenta cyan and black. The numeral 7 is a transfer belt. The numeral 8 is a discharging electrode. The numeral 9 is a cleaning device composed of a fur brush.

The optical unit 10 by which an electrostatic latent image is formed on the photoreceptor drum 1, is provided to the upper portion of the photoreceptor drum 1. The optical unit 10 is composed of the polygon mirror 11 rotating at a high speed, the f-$\theta$ lens 12, the mirrors 13 and 14, the cylindrical lens 15, and the mirror 16 so that the laser beam modulated by the color image signal can be deflected, wherein the laser beam is generated by the laser unit which is not illustrated in the drawing. Then the laser beam is projected on the surface of the photoreceptor drum 1.

Referring now to the timing chart illustrated in FIG. 2, the basic recording motion of this apparatus will be briefly explained as follows.

Before the start signal is outputted, the transfer belt 7 and the cleaning device 9 are separated from the surface of the photoreceptor drum 1. When the start signal is outputted, the rotation of the photoreceptor drum 1 is started and it is rotated in the arrowed direction. At the same moment, the surface of the photoreceptor drum 1 is uniformly charged by the charging electrode 2.

On the other hand, the laser beam modulated by the yellow component signal which was obtained by the color-separation of the color image signal, is emitted from the optical unit 10 and the electrostatic latent image of a yellow component is formed on the photoreceptor drum 1 by the laser beam. The electrostatic latent image formed in this way, is developed by the developing unit 3 as a yellow toner image.

After the photoreceptor drum 1 has been rotated by approximately revolution and the surface of the photoreceptor drum is charged again by the charging electrode 2, an electrostatic latent image is formed by the laser beam modulated by the signal of the magenta component. This electrostatic latent image is developed by the developing unit 4 containing the magenta toner.

In the same way, an electrostatic latent image is formed by the laser beam modulated by the signal of the cyan component. This electrostatic latent image is developed by the developing unit 5 containing the cyan toner. Finally, an electrostatic latent image formed by the laser beam modulated by the signal of the black component, is developed by the developing unit 6 containing the black toner.

Figure 2:
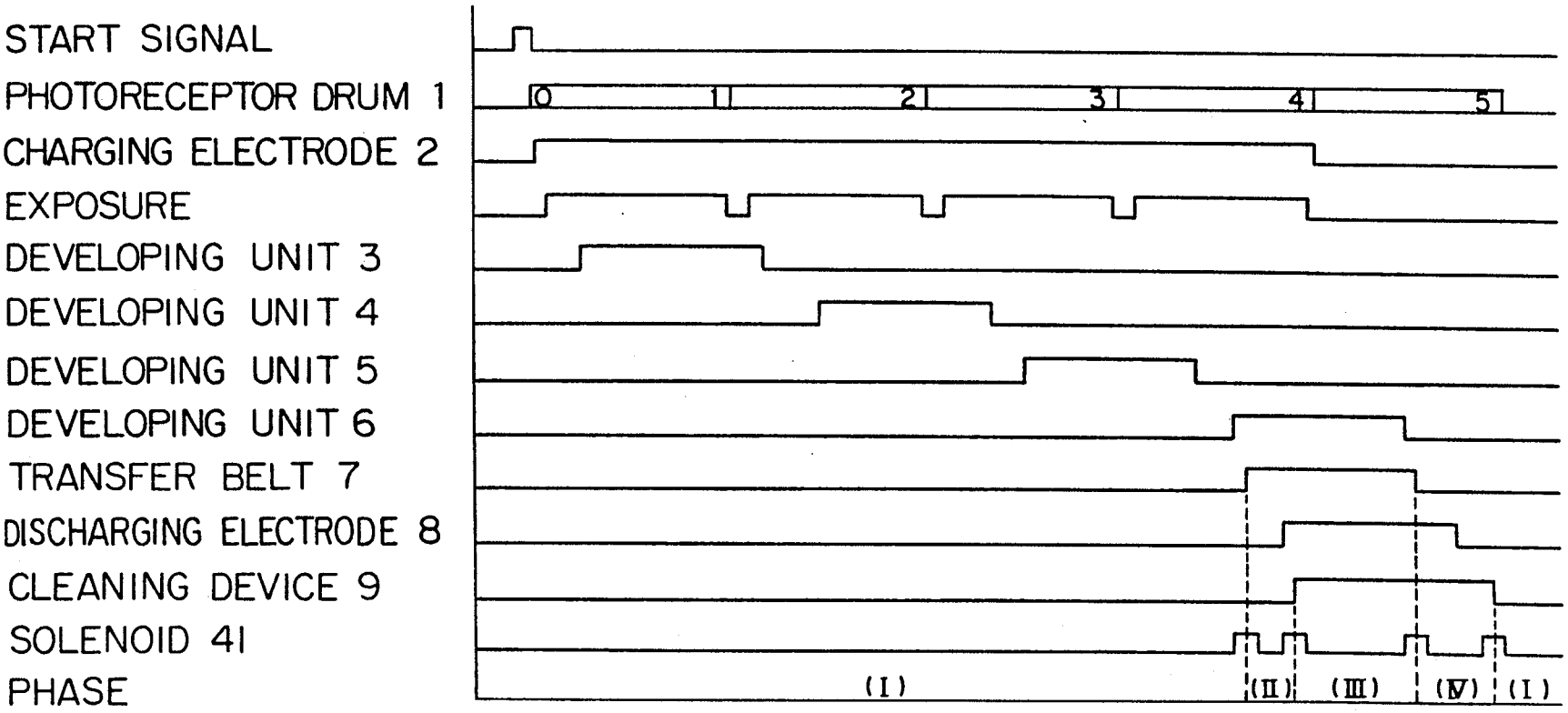
FIG. 2 is a timing chart which explains the motion of the color printer illustrated in FIG. 1.

It can be realized from the timing chart in FIG. 2 that the transfer belt 7 is pressed against the surface of the photoreceptor drum 1 synchronously with the motion of the developing unit 6. Before the transfer belt 7 is pressed against the photoreceptor drum, a recording paper is sent by the semicircular paper feeding roller 21 from the paper cassette 20 which is provided to the lower portion of the printer. Then the recording paper is conveyed by the conveyance roller 22 and bumps against the second paper feeding roller 23 so that the recording paper can wait for the following motion. This recording paper is conveyed to the transfer portion by the second paper feeding roller 23, wherein the second paper feeding roller 23 is rotated at the time when the leading portion of the color image formed on the photoreceptor surface coincides in position with the leading portion of the recording paper.

At the transfer unit, the color image formed on the photoreceptor drum 1 is transferred onto the recording paper by the action of the transfer belt 7. The recording paper onto which the color image was transferred, is conveyed to the fixing unit by the action of the transfer belt 7. In the fixing unit, the color image is heat-fixed by the fixing roller 24. The fixed recording paper is conveyed by the conveyance rollers 25, 26 and 27 and delivered onto the delivery tray 28.

The photoreceptor drum 1 is discharged by the discharging electrode 8 at the more downstream position of the photoreceptor drum rotation than the position where the recording paper was separated from the surface of the photoreceptor drum. Then, the cleaning device 9 is pressed against the photoreceptor drum surface so that the residual toner on the drum surface can be removed.

Figure 3:
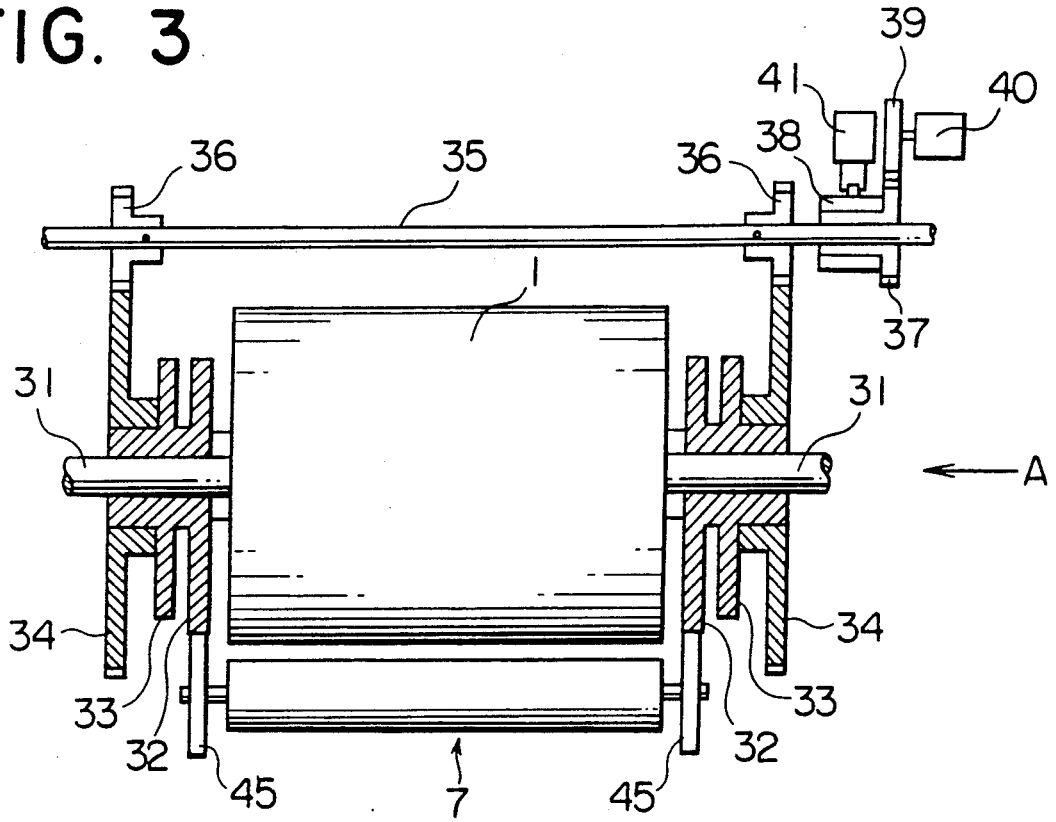
FIG. 3 and FIG. 4 are drawings in which the main portions of the color printer shown in FIG. 1 relating to the present invention, are illustrated.
Figure 4:
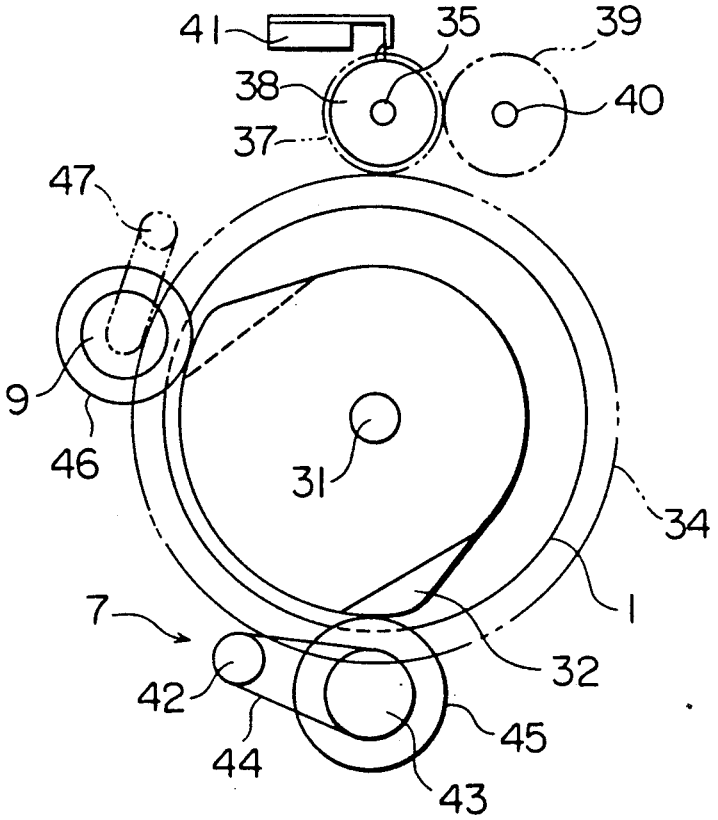

Referring to FIG. 3 and FIG. 4, the details of the pressing and releasing mechanism of the present invention will be explained. FIG. 3 is a sectional view taken on the plane of the shaft of the photoreceptor drum 1. FIG. 4 is a side view taken from the direction of an arrow mark "A" of FIG. 3.

The cam 32 for use in releasing the transfer belt 7 and the cam 33 for use in releasing the cleaning device 9 are rotatably provided to the shaft 31 of the photoreceptor drum 1, wherein these cams are integrally formed and fixed to the gear 34. The gear 34 engages with the gear 36 which is fixed to the shaft 35. The shaft 35 is provided with the spring clutch 38 having the gear 37. The gear 37 is driven by the motor 40 through the gear 39. The drive force transmission is controlled by the solenoid 41. When the solenoid 41 is turned on, the hook of the solenoid 41 comes into contact with the claw of the spring clutch 38 (Refer to FIG. 4.). Accordingly, the drive force of the motor 40 is transmitted to the cams and the cams 32 and 33 are rotated according to the number of revolution of the motor 40. When a step motor is used instead of the motor 40, the revolutions of the cams 32 and 33 can be precisely controlled without using the spring clutch.

As illustrated in FIG. 4, the transfer belt unit 7 is composed of the rollers 42 and 43, and the belt 44 which is stretched between the rollers 42 and 43. The transfer belt unit 7 can be rotated around the roller 42 and it is pushed by a spring member not illustrated in the drawing, in the direction to the photoreceptor drum 1 so that it can be pressed against the drum 1. The spacing roller 45 is provided to the shaft of the roller 43 so that the transfer belt 7 can be pressed and released by the spacing roller 45 whose position is regulated by the cam 32.

The numeral 46 is a spacing roller which is provided to the edge portion of the cleaning device (a fur brush) 9, wherein the cleaning device 9 can be rotated around the supporting point 47 and is pushed by a spring member not illustrated in the drawing, in the direction to the photoreceptor drum 1. The cam 33 regulates the position of the spacing roller 46 according to its rotation so that the cleaning device 9 can be pressed against the photoreceptor drum and released from it.

The above-described mechanisms are symmetrically provided to the right and left sides of the photoreceptor drum 1 and the cleaning device 9 is not illustrated in FIG. 3.

The motions of the press and release mechanism will be explained as follows.

As illustrated in FIG. 2, the motions comprise four phases. The phases I to IV can be realized as follows: the solenoid 41 is magnetized and demagnetized as illustrated in FIG. 2; the cams 32 and 33 are rotated by the motor 40 according to the magnetization and demagnetization; and the positions of the transfer belt 7 and the cleaning device 9 are regulated by the rotation of the cams. FIGS. 5(A) to 5(D) show the cam positions at Phase I to Phase IV.

In Phase I, the cams 32 and 33 push the cam followers 45 and 46 as illustrated in FIG. 5(A) so that the transfer belt 7 and the cleaning device 9 are separated from the photoreceptor drum 1. While the above-described motions are performed, the photoreceptor drum 1 is rotated by 4 revolutions and a color image is formed on the surface of the photoreceptor drum 1.

In Phase II, the cam 33 continues to push the cam follower 46 and the cleaning device 9 is separated from the photoreceptor drum 1 as illustrated in FIG. 5(B). However, since the cam 32 is separated from the cam follower 45, the transfer belt 7 is pressed against the photoreceptor drum 1 and transfer is started.

In Phase III, both of the cam 32 and the cam 33 are separated from the cam followers 45 and 46 as illustrated in FIG. 5(C). Accordingly, both the transfer belt 7 and the cleaning device 9 are pressed against the photoreceptor drum 1. In this state, transfer is continued and cleaning is started.

In Phase IV, as illustrated in FIG. 5(D), the cam 33 continues to be separated from the cam follower 46 and the cleaning device 9 is pressed against the photoreceptor drum 1. However, the cam 32 pushes the cam follower 45 and the transfer belt is released from the contact with the photoreceptor drum 1, so that transfer is completed and the transfer paper is conveyed to the fixing portion. After that, the apparatus is returned to Phase I and the cleaning device is released from the contact with the photoreceptor drum.

In the example described above, the cleaning device is pressed against the photoreceptor drum after the contact of the transfer belt with the photoreceptor drum. However, the order should be determined according to the arrangement of the cleaning device and the size of the photoreceptor drum, so that it should be understood that the motion timing of the press of the transfer belt and that of the cleaning device is not limited by the specific embodiment. If it is necessary, both of them may be pressed against the photoreceptor drum at the same moment or the cleaning device may be pressed previous to the transfer belt. Although a fur-brush-type cleaning device is used in this example, other cleaning means such as a blade-type cleaning device may be used. Furthermore, although two cams are used in this example, they may be replaced by one cam with two cam guides.

Referring to the drawings, the second example of the present invention will be explained.

Figure 6:
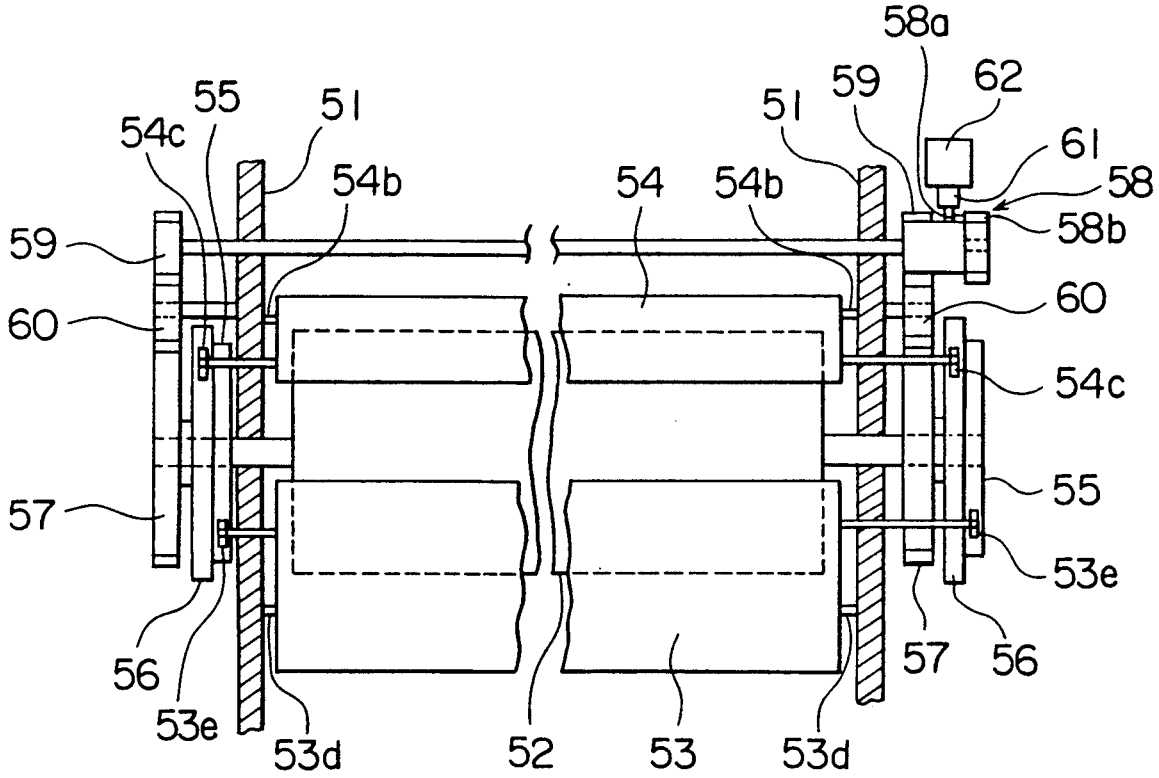
FIG. 6 is a partial front view of the color electrophotographic apparatus of the present invention.
Figure 7:
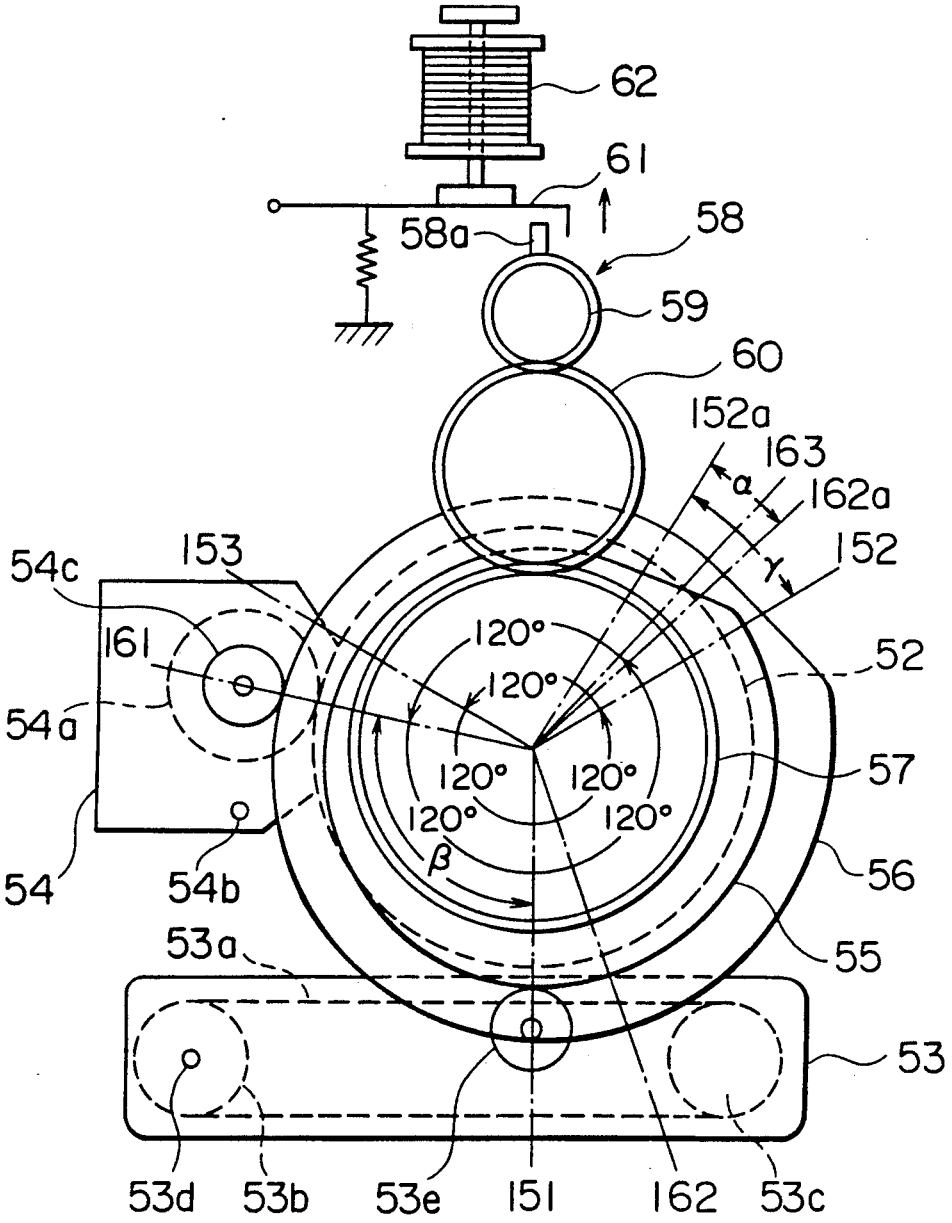
FIG. 7 is a partial side view of the color electrophotographic apparatus of the present invention.

FIG. 6 is a partial front view of the second example of the color electrophotographic apparatus of the present invention. FIG. 7 is a partial side view of the apparatus described above. In the drawings, the numeral 51 is a frame of the apparatus. The numeral 52 is a photoreceptor drum which is rotated clockwise in FIG. 7. The numeral 53 is a transfer means frame. The numeral 54 is a cleaning means frame.

The structure of the transfer means frame 53 can be described as follows: the transfer means frame 53 holds the belt drive rollers **53*b* and 53*c* between which the transfer belt 53*a* is stretched; the transfer means frame 53 is held by the apparatus frame 51 as illustrated in FIG. 6, wherein the transfer means frame 53 can be rotated around the shaft 53*d* of the belt drive roller 53*b*; the transfer means frame 53 is pushed counterclockwise in FIG. 7 by a pushing means such as a spring which is not illustrated in the drawing; and as the transfer means frame 53 is pushed, the cam follower 53*e* provided to the transfer means frame 53 always comes into contact with the cam 55 which is rotated around the shaft of the photoreceptor drum 52. A color image made by superimposing toner images which were formed on the photoreceptor drum 52, is transferred onto the transfer belt 53*a*, and the color image is transferred onto a transfer paper from the transfer belt at the downstream portion of the drive roller 53*b*, wherein the transfer paper is not illustrated in the drawing. After transfer, the surface of the transfer belt is cleaned by a transfer belt cleaning means not illustrated in the drawing at the right side position of the belt drive roller 53*c***. A transfer paper conveyance means not illustrated in the drawing and the above-described transfer belt cleaning means are provided to the apparatus so that they can not interrupt the motions of the transfer means which is attached to and removed from the photoreceptor drum.

The structure of the cleaning means frame 54 can be explained as follows: the cleaning means frame 54 holds the fur brush roller **54*a* which cleans the surface of the photoreceptor drum 52 after the color image has been transferred; the cleaning means frame 54 is supported by the apparatus frame 51 as illustrated in FIG. 6, wherein the cleaning means frame 54 can be rotated around the shaft 54*b* which is provided under the fur-brush roller 54*a*; the cleaning means frame 54 is pushed clockwise in FIG. 7 by a pushing means such as a spring means not illustrated in the drawing; and as the cleaning means frame 54 is pushed, the cam follower 54*c* provided to the cleaning means frame 54, comes into contact with the cam 56 which is rotated around the shaft of the photoreceptor drum 52**.

The cam 55 and the cam 56 are integrally formed, and furthermore they are integrally composed with the cam gear 57. The cam gear 57 is connected with the output shaft gear 59 which is rotated integrally with the output shaft of the spring clutch 58 through the carrier gear 60. The gear ratio between the number Z7 of teeth of the cam gear 57 and the number Z9 of teeth of the output shaft gear 59, is set to $Z7/Z9=3$. When the pin **58*a* is engaged with the engagement hook 61, the spring clutch 58 is not rotated and the rotation of the input shaft gear 58*b* is not transmitted to the output shaft gear 59, in other words they are in the state of interception. When the solenoid 62 is excited, the engagement hook 61 is withdrawn in the direction of an arrow mark in FIG. 7 and the pin 58*a* is rotated together with the input shaft gear 58*b* so that the rotation is transmitted to the output shaft gear 59, in other words they are in the state of connection. The solenoid 62 is excited for a short period of time necessary for the engagement hook 61 to be released from the pin 58*a*. When the engagement hook 61 engages with the pin 58*a* of the spring clutch 58, the cams 55 and 56 are not rotated even if the input shaft gear 58*b* is rotated by a power source not illustrated in the drawings. When the solenoid 62 is excited once, the engagement hook 61 is released from the pin 58*a*, and the pin 58*a* and the output shaft gear 59 is rotated by one revolution and the cams 55 and 56 are rotated by $\frac{1}{3}$ revolution and stay there until the engagement hook 61 engages with the pin 58*a* next time. Accordingly, when the solenoid 62 is excited three times, the cams 55 and 56 are rotated by one revolution, wherein the pin 58*a* is released from the engagement hook 61 by exciting the solenoid 62**.

When the cams 55 and 56 are stopped at the positions illustrated in FIG. 7, the transfer belt **53*a* of the transfer means is separated from the surface of the photoreceptor drum 52 and the fur-brush roller 54*a* of the cleaning means comes into contact with the surface of the photoreceptor drum 52. The above-described state of the apparatus is kept from the time when the photoreceptor drum 52 is not rotated until the photoreceptor drum 52 starts rotation and image exposure is conducted in order to form the first toner image. When the start button, not illustrated in the drawings, is pressed under this condition and the photoreceptor drum 52 is rotated, the fur-brush roller 54*a* is also rotated so that the surface of the photoreceptor drum 52 can be cleaned and then its surface is uniformly charged by a charger not illustrated in the drawings. After that, the solenoid 62 is excited in the way described above, and the cams 55 and 56 are rotated by $\frac{1}{3}$ revolution and then they are stopped. Before the rotation, the cam 55 came into contact with the cam follower 53*e* at the line 151 of FIG. 7, and this rotation phase of the cams are called the phase 151 hereafter. After the cam 55 is rotated by $\frac{1}{3}$ revolution, the cam 55 comes into contact with the cam follower 53*e* at the phase 152. However, the transfer belt 53*a* of the transfer means is still separated from the surface of the photoreceptor drum 52. Before the rotation, the cam 56 came into contact with the cam follower 54***c* at the phase 161. However, after the cam 56 is rotated by ⅓ revolution, it comes into contact with the cam follower 54*c* at the phase 162. For that reason, the fur-brush roller 54*a* of the cleaning means is separated from the surface of the photoreceptor drum 52. In this state, image exposure is conducted on the surface of the photoreceptor drum 52 which is uniformly charged, and the development of the electrostatic latent image formed on the photoreceptor surface is repeated so that the toner image can be obtained. In this way, a color image formed by superimposing different color toner images can be obtained. The solenoid 62 is excited again s that the transfer belt 53*a* can come into contact with the photoreceptor drum 52 at least when the tip of the formed color image reaches the position in which the transfer belt 53*a* comes into contact with the photoreceptor drum 52 or a little before the tip of the color image reaches the position, wherein the position is called the transfer position. When the solenoid is excited again, the cams 55 and 56 are rotated by ⅓ revolution again, and after the rotation they are stopped. Before the rotation of the cam 55, it comes into contact with the cam follower 53*e* at the phase 152. However, after the rotation of the cam 55, it comes into contact with the cam follower 53*e* at the phase 153. After the phase 152*a*, the transfer belt 53*a* comes into contact with the photoreceptor drum 52. Before the rotation, the cam 56 comes into contact with the cam follower 54*c* at the phase 162. After the rotation, the cam 56 comes into contact with the cam follower 54*c* at the phase 163. After the phase 162*a*, the fur-brush roller 54*a* comes into contact with the photoreceptor drum 52. In this way described above, the color image is transferred onto the transfer belt 53*a* and then transferred onto a transfer paper. After that, the color image is fixed by a fixing means. After the color image transfer, the surface of the photoreceptor drum 2 is cleaned by the fur-brush roller 54*a*.

The following two angles are almost equal: one is the angle which can be obtained by subtracting the angle $\alpha$ from the angle 120°, wherein the angle $\alpha$ is defined as the angle between the phase 152*a* of the cam 55 and the phase 162*a* of the cam 56; and the other is the angle $\beta$, wherein the angle $\beta$ is defined as the angle between the point where the transfer belt 53*a* comes into contact with the photoreceptor drum 52 and the point where the fur-brush roller 54*a* comes into contact with the photoreceptor drum 52. Since the phases of the cams are set in the way described above, if the transfer belt 53*a* comes into contact with the photoreceptor drum 52 when the leading edge of a color image reaches the transfer position, the fur-brush roller 54*a* comes into contact with the photoreceptor drum 52 when the leading edge of the color image on the photoreceptor drum 52 after transfer reaches the position of the fur-brush roller 54*a*. Accordingly, the surplus of the circumference of the photoreceptor drum 52 can be reduced with regard to the circumferential length of the color image.

When the pitch circle speed of the output shaft gear 59 rotated at a speed of the input shaft gear 58*b* of the spring clutch 58, is made equal to the circumferential speed of the photoreceptor drum 52, and when the solenoid 62 is excited at the moment when the leading edge of a color image reaches the position separated counterclockwise from the position where the transfer belt 53*a* comes into contact with the photoreceptor drum 52 by the angle of $\gamma$, the angle between the phase 152 and 152*a*, or a little more, the transfer belt 53*a* can come into contact with the photoreceptor drum 52 at the moment when the leading edge of the color image reaches the transfer position. Accordingly, when the leading edge of the color image reaches the position of the fur-brush roller 54*a*, the fur-brush roller 54*a* can come into contact with the photoreceptor drum 52.

The solenoid 62 is excited again when the trailing edge of the color image reaches the transfer position or right after that. Since the solenoid 62 is excited, the cams 55 and 56 are rotated by ⅓ revolution, and after that the rotation is stopped. Before the excitation of the solenoid, the cam 55 came into contact with the cam follower 53*e* at the phase 153. However, after the excitation, the cam 55 comes into contact with the cam follower 53*e* again at the phase 151 as illustrated in FIG. 7. Consequently, the transfer belt 53*a* is separated from the photoreceptor drum 52. The cam 56 came into contact with the cam follower 54*c* at the phase 163. However, it comes into contact with the cam follower again at the phase 161 as illustrated in FIG. 7. In this step, the fur-brush roller 54*a* is kept to be in contact with the photoreceptor drum 52. When a color image is formed next time, the above-described motions are repeated. Although the fur-brush roller 54*a* and the transfer belt 53*a* may be rotated in accordance with the rotation of the photoreceptor drum 52, it is preferable that they are rotated only while they come into contact with the photoreceptor drum 52.

It should be understood that the color electrophotographic apparatus of the present invention is not limited to the specific examples. It can be applied to the following types of apparatuses: an apparatus in which a color image can be directly transferred onto a transfer paper by the transfer means characterized in that a transfer paper is pressed against the photoreceptor drum surface by the transfer electrode roller or corona discharge is conducted from the back of a transfer paper which was conveyed so that it could come into contact with the photoreceptor surface; an apparatus provided with a cleaning means which cleans the surface of the photoreceptor by a blade; and an apparatus in which a clutch or a drive motor can be operated according to the detection signal of marks attached to the cam or to the gear, wherein the marks are provided at each ⅓ revolution of the cam or the gear. Needless to add, the present invention can be applied to an apparatus in which the cams and gears are provided only to one side of the photoreceptor drum. In the example illustrated in the drawings, the cams and gears provided to both sides of the photoreceptor drum have the same structure.

In the color electrophotographic apparatus of the present invention, the transfer means and the cleaning means are attached to and removed from the photoreceptor drum with almost common means at the same moment and the number of parts is small. Accordingly, the apparatus of the invention possesses the advantage of low cost and few chances of a mechanical trouble.

what is claimed is:

1. An electrophotographic apparatus comprising:

a photoreceptor drum which rotates around an axis in a rotation direction;

developing means for developing a toner image on the surface of the photoreceptor drum;

transfer means, located at the periphery of the photoreceptor drum, for transferring the toner image from the surface onto a recording sheet, disposed at a transfer position in contact with the surface to transfer the toner image during a transfer time interval, and disposed at a non-transfer position separated from the surface during a non-transfer time interval;

cleaning means, located downstream of the transfer means in the rotation direction, for removing residual toner left on the surface of the photoreceptor drum after the toner image has been transferred, disposed at a cleaning position in contact with the surface to remove the residual toner during a cleaning time interval, and disposed at a non-cleaning position separated from the surface during a non-cleaning time interval; and cam means for shifting the transfer means and the cleaning means, including a cam rotatable around the axis of said photoreceptor drum, and cam follower means engaged by the cam, wherein the cam follower means, in response to rotation of said cam, shifts the transfer means to the transfer position during the transfer time interval and to the non-transfer position during the non-transfer time interval, and shifts the cleaning means to the cleaning position during the cleaning time interval and to the non-cleaning position during the non-cleaning time interval.

2. The electrophotographic apparatus of claim 1, wherein the cam of said cam means includes a transfer cam and a cleaning cam being integrally connected;

said cam means further including drive means for driving the transfer and cleaning cams to rotate of said photoreceptor drum;

said cam following means including a transfer cam follower means driven by the transfer cam for shifting the transfer means to the transfer position in the transfer time interval and to the non-transfer position in the non-transfer time interval; and said cam follower means including a cleaning cam following means driven by the cleaning cam for shifting the cleaning means to the cleaning position in the cleaning time interval and to the non-cleaning position in the non-cleaning time interval.

3. The electrophotographic apparatus of claim 2, in which the drive means drives the transfer and cleaning cams intermittently to rotate one-third of a revolution so as to stop them sequentially at a first angle, a second angle and a third angle of rotation within one revolution of thereof, and the transfer cam follower means shifts the transfer means from the non-transfer position to the transfer position at a transfer-start angle of rotation between the second angle and the third angle, and shifts the transfer means from the transfer position to the non-transfer position at a transfer-stop angle of rotation between the third angle and the first angle, and the cleaning cam follower means shifts the cleaning means from the non-cleaning position to the cleaning position at a cleaning-start angle of rotation between the second angle and the third angle, and shifts the cleaning means from the stop angle between the first angle and the second angle.

4. The electrophotographic apparatus of claim 3, wherein;

the cleaning cam follower means shifts the cleaning means from the cleaning position to the non-cleaning position at the time when the photoreceptor drum has rotated a predetermined angle between the transfer means and the cleaning means after the shift of the transfer means from the transfer position to the non-transfer position.

* * * * *